US009332614B2

(12) United States Patent
Vaughan et al.

(10) Patent No.: US 9,332,614 B2
(45) Date of Patent: May 3, 2016

(54) LED DRIVER CIRCUIT WITH OPEN LOAD DETECTION

(71) Applicant: Power Integrations, Inc., San Jose, CA (US)

(72) Inventors: Peter Vaughan, Los Gatos, CA (US); Ricardo L. J. Pregitzer, Campbell, CA (US)

(73) Assignee: Power Integrations, Inc., San Jose, CA (US)

( * ) Notice: Subject to any disclaimer, the term of this patent is extended or adjusted under 35 U.S.C. 154(b) by 0 days.

(21) Appl. No.: 14/500,841

(22) Filed: Sep. 29, 2014

(65) Prior Publication Data

US 2016/0095174 A1 Mar. 31, 2016

(51) Int. Cl.
*H05B 37/02* (2006.01)
*H05B 33/08* (2006.01)

(52) U.S. Cl.
CPC ..... *H05B 33/089* (2013.01); *H05B 33/0845* (2013.01); *H05B 37/02* (2013.01)

(58) Field of Classification Search
CPC ..... H05B 33/089; H05B 33/0845
See application file for complete search history.

(56) References Cited

U.S. PATENT DOCUMENTS

2011/0241557 A1* 10/2011 Grotkowski ..... H05B 33/0824 315/246
2011/0309759 A1* 12/2011 Shteynberg et al. ..... 315/201
2012/0126714 A1* 5/2012 Deppe ..... H05B 33/0815 315/192
2012/0299572 A1* 11/2012 Eom ..... H05B 33/0815 323/312
2013/0293127 A1* 11/2013 Tuffyas ..... H05B 33/0809 315/192
2014/0159616 A1* 6/2014 Wang et al. ..... 315/307

* cited by examiner

*Primary Examiner* — Tung X Le
*Assistant Examiner* — Raymond R Chai
(74) *Attorney, Agent, or Firm* — Blakely Sokoloff Taylor & Zafman LLP

(57) ABSTRACT

Various examples directed to LED driver circuits capable of detecting the removal of an LED load are disclosed. In one example, the LED driver circuit may include a bleeder and load disconnect detection circuit having a bleeder circuit and a bleeder controller coupled to control the bleeder circuit. The bleeder controller may cause the bleeder circuit to draw a bleeder current that functions to supplement a load current drawn by an LED load to cause an input current of the LED driver circuit to be greater than a minimum holding current of a dimmer circuit. The bleeder controller may be further configured to detect a disconnect of the LED load based on the input current of the LED driver circuit, the bleeder control signal, and/or the bleeder current. In response to detecting a disconnect of the LED load, the bleeder controller may disable operation of the bleeder circuit.

15 Claims, 8 Drawing Sheets

LED DRIVER CIRCUIT WITH OPEN LOAD DETECTION

BACKGROUND

1. Field

The present disclosure relates generally to circuits for driving light-emitting diodes (LEDs) and, more specifically, to LED driver circuits with open load detection.

2. Related Art

LED lighting has become popular in the industry due to the many advantages that this technology provides. For example, LED lamps typically have a longer lifespan, require less power, pose fewer hazards, and provide increased visual appeal when compared to other lighting technologies, such as compact fluorescent lamp (CFL) or incandescent lighting technologies. The advantages provided by LED lighting have resulted in LEDs being incorporated into a variety of lighting technologies, televisions, monitors, and other applications.

It is often desirable to implement LED lamps with a dimming functionality to provide variable light output. One known technique that has been used for analog LED dimming is phase-angle dimming, which may be implemented using either leading-edge or trailing-edge phase-control. A semiconductor switch-based circuit (e.g., TRIAC or MOSFET) is often used to perform this type of phase-angle dimming and operates by delaying the beginning of each half-cycle of alternating current (ac) power or trimming the end of each half-cycle of ac power. By delaying the beginning of each half-cycle or trimming the end of each half-cycle, the amount of power delivered to the load (e.g., the lamp) is reduced, thereby producing a dimming effect in the light output by the lamp. In most applications, inconsistences in the delay at the beginning of each half-cycle or in trimming of the end of each half-cycle are not noticeable because the resulting variations in the phase-controlled line voltage and power delivered to the lamp either occur more quickly than can be perceived by the human eye or are averaged by the naturally slow response of the lamp. For example, dimmer circuits work especially well when used to dim incandescent light bulbs since the variations in phase-angle with altered ac line voltages are averaged by the thermal time constant of the lamp. However, flicker may be noticed when dimmer circuits are used for dimming LED tamps.

Flickering in LED lamps can occur because these devices are typically driven by LED drivers having regulated power supplies that provide regulated current and voltage to the LED lamps from ac power lines. Unless the regulated power supplies that drive the LED lamps are designed to recognize and respond to the voltage signals from dimmer circuits in a desirable way, the dimmer circuits are likely to produce non-ideal results, such as limited dimming range, flickering, blinking, and/or color shifting in the LED lamps.

Difficulties arise with a TRIAC dimmer circuit, because a TRIAC is a semiconductor component that operates as a controlled ac switch. Thus, the TRIAC operates as an open switch to an ac voltage until it receives a trigger signal at a control terminal, causing the switch to close. The switch remains closed as long as the current through the switch is above a value referred to as the "holding current." Most incandescent tamps draw more than the minimum holding current from the ac power source to enable reliable and consistent operation of a TRIAC. However, the comparably low currents drawn by LEDs from efficient power supplies may not meet the minimum holding currents required to keep the TRIAC switches conducting for the same duration in each half-cycle of the ac input voltage. As a result, the TRIAC may trigger inconsistently. In addition, due to the inrush current charging the input capacitance of the driver and because of the relatively large impedance that the LEDs present to the input line, a significant ringing may occur whenever the TRIAC turns on. This ringing may cause even more undesirable behavior as the TRIAC current may fall to zero and turn off the LED load, resulting in a flickering effect.

To address these issues in dimmer circuits, conventional LED driver designs typically rely on current drawn by a dummy load or "bleeder circuit" of the power converter to supplement the current drawn by the LEDs in order to draw a sufficient amount of current to keep the dimmer circuit conducting reliably after it is triggered. These bleeder circuits may typically include passive components and/or active components controlled by a controller or by the converter parameters in response to the load level.

During normal operation, LED drivers provide an output having a controlled current at a voltage that is fixed by the LED load. However, in the event that the LED load is disconnected from the output of conventional LED drivers, the output voltage may rise and damage the components of the driver. In addition, the dissipation in the bleeder circuit may increase above acceptable levels. The bleeder circuit is designed to help maintain the operation of the dimmer circuit and cannot dissipate the increase in output voltage when the LED load becomes disconnected. Thus, it may be desirable to detect load disconnections and open load conditions in LED drivers.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

In the following description, numerous specific details are set forth in order to provide a thorough understanding. It will be apparent, however, to one having ordinary skill in the art that the specific details need not be employed.

Various examples directed to LED driver circuits capable of detecting the removal of an LED load are disclosed. In one example, the LED driver circuit may include a bleeder and load disconnect detection circuit having a bleeder circuit and a bleeder controller coupled to control the bleeder circuit through a bleeder control signal. The bleeder controller may be configured to cause the bleeder circuit to draw a bleeder current that functions to supplement a load current drawn by an LED load in order to cause an input current of the LED driver circuit to be greater than a minimum holding current of a leading-edge dimmer circuit of the LED driver circuit. The bleeder controller may be further configured to detect a disconnection of the LED load based on the input current of the LED driver circuit, the bleeder control signal, and/or the bleeder current. In response to detecting a disconnection of the LED load, the bleeder controller may disable operation of the bleeder circuit.

Figure 1A:
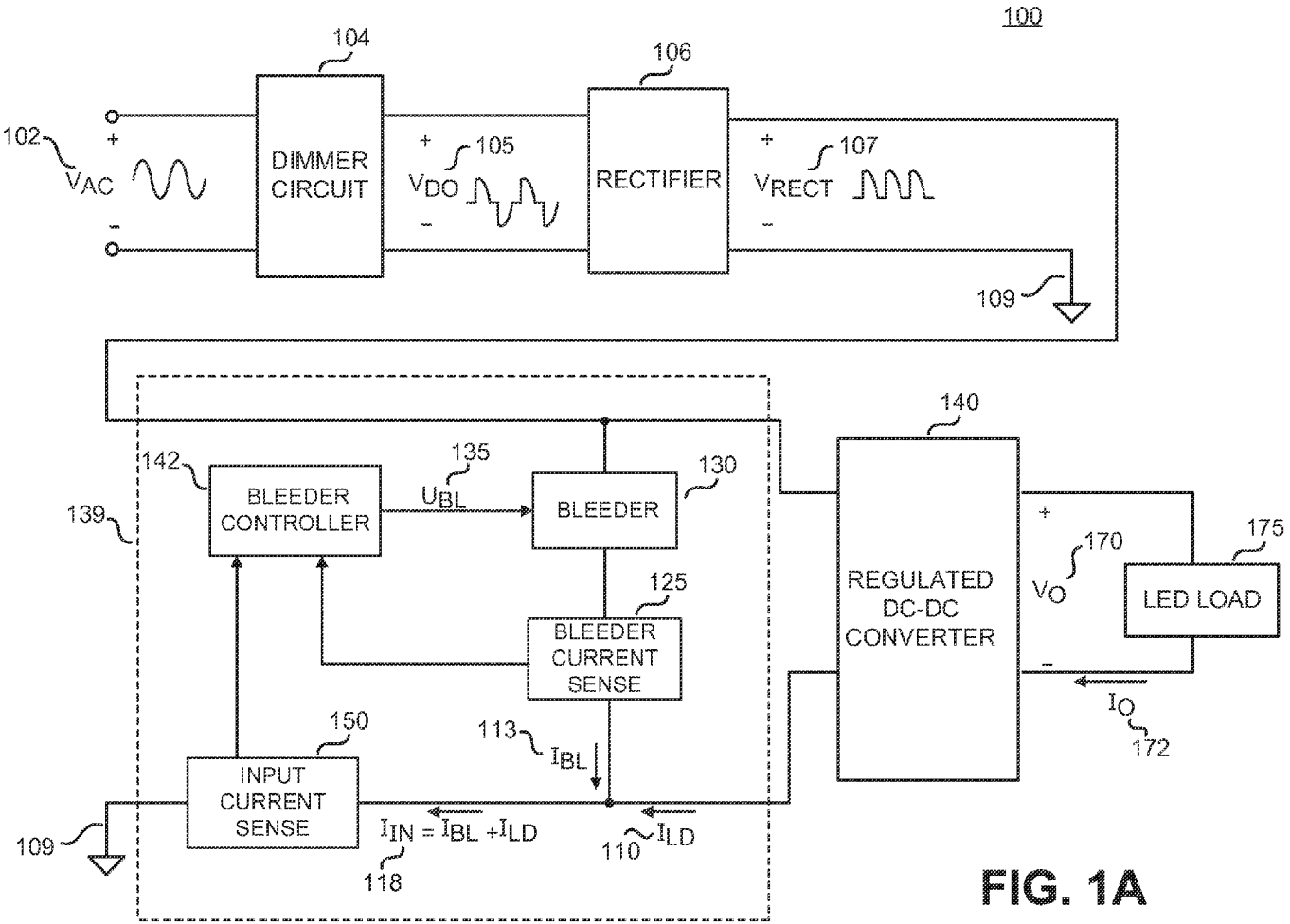
FIG. 1A is a schematic illustrating an example LED driver circuit having a load disconnect detection circuit according to various examples.

FIG. 1A shows a general block diagram of an example LED driver circuit 100 having a bleeder and load disconnect detection circuit 139 according to various examples. In one embodiment, the input voltage is an ac input voltage $V_{AC}$ 102 to produce dimmer output voltage $V_{DO}$ 105. The dimmer output voltage is received by the rectifier 106 to produce a rectified voltage $V_{RECT}$ 107. In one example, rectifier 106 may include a full-wave rectifier circuit.

As shown in the depicted example, the rectified voltage $V_{RECT}$ 107 has a conduction phase-angle in each half line cycle that is controlled by dimmer circuit 104. The phase-controlled rectified input voltage $V_{RECT}$ 107 provides an adjustable average dc voltage to a regulated dc-de converter 140 through bleeder and load disconnect detection circuit 139. By removing a portion of each half-cycle of the input ac line signal $V_{AC}$ 102 using dimmer circuit 104, the amount of power delivered to the load 175 may be reduced and the light output by the LED appears dimmed. While shown as a dimmer circuit implementing leading-edge phase-control, it should be appreciated that dimmer circuit 104 can additionally or alternatively implement trailing-edge phase-control.

Bleeder and load disconnect detection circuit 139 may include an input current sense circuit 150, bleeder circuit 130, bleeder controller 142, and a bleeder current sense circuit 125. Bleeder controller 142 may be configured to control bleeder circuit 130 with control signal 135 based on a current sense signal representative of bleeder current $I_{BL}$ 113 from bleeder current sense circuit 125 and an input current sense signal representative of input current $I_{IN}$ 118 from an input current sense circuit 150. The input current $I_{IN}$ 118 may be representative of the bleeder current $I_{BL}$ 113 and a load current $I_{LD}$ 110. An example circuit implementation for bleeder and load disconnect detection circuit 139 is described below with respect to FIG. 1B and a more detailed description of the operation of bleeder and load disconnect detection circuit 139 is described below with respect to FIGS. 2-6.

LED driver circuit 100 may further include regulated dc-dc converter 140 coupled to the output of bleeder and load disconnect detection circuit 139 and configured to generate a regulated output that may include output voltage $V_O$ 170 and/or output current $I_O$ 172 to the LED load 175. It should be appreciated that regulated dc-dc converter 140 may be an isolated or non-isolated converter. Non-limiting examples of isolated converters include Flyback and forward converters, and non-limiting examples of non-isolated converters include non-isolated Buck-Boost converters, Buck converters, and Tapped Buck converters.

Figure 1B:
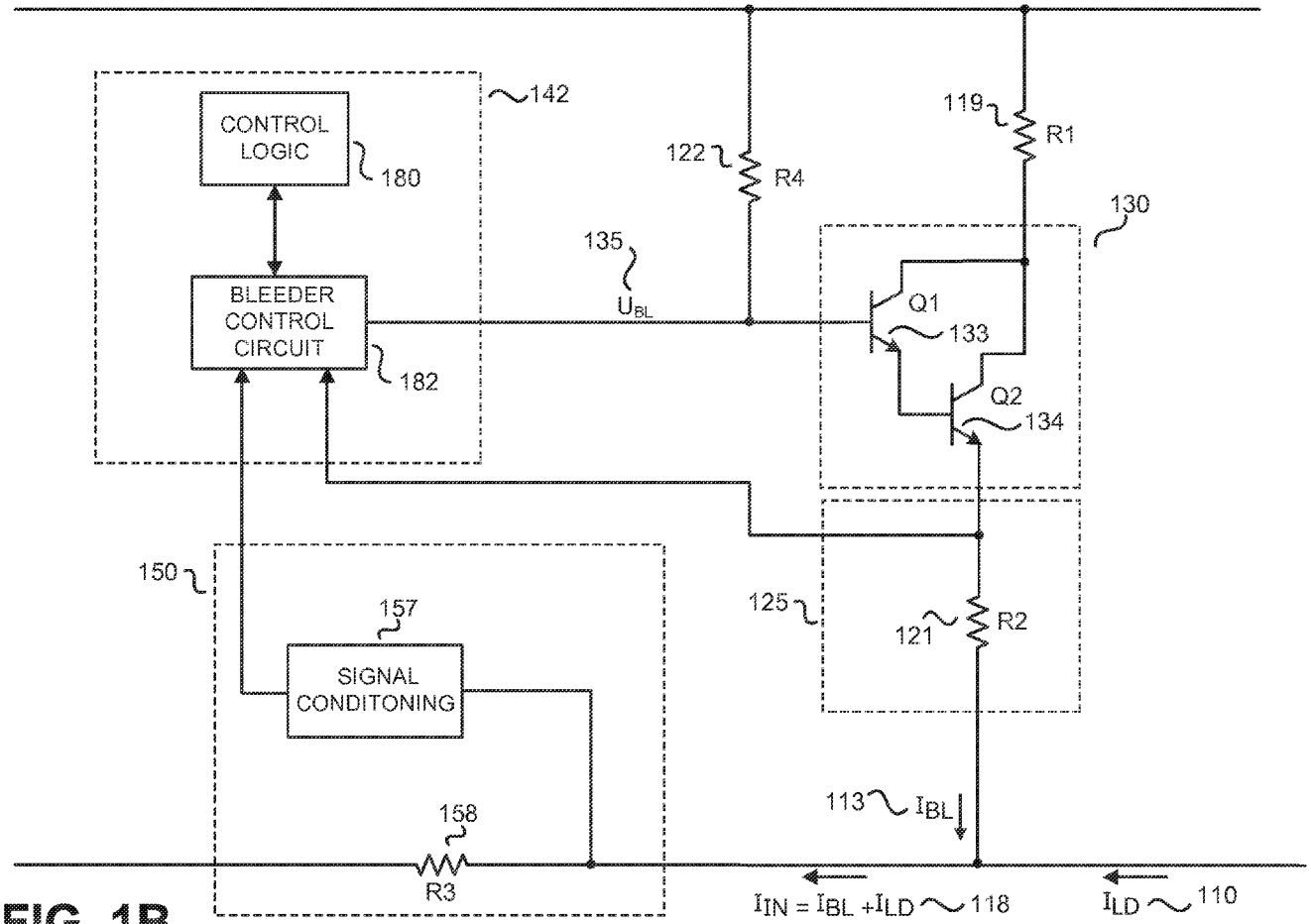
FIG. 1B is a circuit diagram illustrating an example bleeder and load disconnect detection circuit.

FIG. 1B shows an example circuit implementation for bleeder and load disconnect detection circuit 139. As shown, bleeder controller 142 may include, but is not limited to, control logic block 180 coupled to bleeder control circuit 182. Bleeder control circuit 182 may be coupled to receive a bleeder current sense signal representative of bleeder current $I_{BL}$ 113 from bleeder current sense circuit 125 and an input current sense signal representative of input current $I_{IN}$ 118 from input current sense circuit 150. Bleeder control logic 180 may be coupled to control bleeder control circuit 182 to output bleeder control signal $U_{BL}$ 135 to bleeder circuit 130. Control logic block 180 may interpret the signals received by bleeder control circuit 182, and send a signal to the bleeder control circuit 182 to output the bleeder control signal $U_{BL}$ 135. Control logic block 180 may comprise of digital logic gates, such as AND, OR, and NOT gates, as well as counters or timers.

Bleeder circuit 130 may include, but is not limited to, a Darlington pair having transistor Q1 133 and transistor Q2 134. The base of transistor Q1 133, may be pulled-up through resistor 122, causing transistor Q1 133 and transistor Q2 134 to remain activated and sinking a bleeder current $I_{BL}$ 113 through resistor 119, bleeder current sense circuit 125, and input current sense circuit 150. Sense resistor 121 of bleeder current sense circuit 125 may be used to provide a bleeder current sense signal representing the bleeder current $I_{BL}$ 113 to bleeder controller 142.

The bleeder circuit 130 may be configured to draw a bleeder current $I_{BL}$ 113 that depends at least in part on the bleeder control signal $U_{BL}$ 135 from bleeder controller 142. The bleeder current $I_{BL}$ 113 drawn by bleeder circuit 130 may function to supplement the load current $I_{LD}$ 110 in order to cause the input current $I_{IN}$ 118 (e.g., bleeder current $I_{BL}$ 113 plus load current $I_{LD}$ 110) drawn from the LED driver circuit 100 to be greater than a minimum holding current $I_{MIN}$ required to keep the switch of dimmer circuit 104 conducting.

Input current sense circuit 150 may include a signal conditioning block 157 and a current sense resistor 158. Current sense resistor 158 may be coupled to receive input current $I_{IN}$ 118, which may include a summation of bleeder current $I_{BL}$ 113 and load current $I_{LD}$ 110. A signal conditioning block may be coupled to receive the signal representative of input current $I_{IN}$ 118 from current sense resistor 158. The signal conditioning block 157 may be configured to provide for example, but not limited to, a lower pass filter characteristic.

Bleeder controller 142 may be configured to maintain the input current $I_{IN}$ 118 above the minimum holding current $I_{MIN}$ by adjusting bleeder current $I_{BL}$ 113 drawn by the bleeder circuit 130 via the bleeder control signal 135. Bleeder controller 142 may output bleeder control signal 135 based at least in part on the difference between input current $I_{IN}$ 118 and the minimum holding current $I_{MIN}$. For example, bleeder controller 142 may be configured to output a bleeder control signal 135 that causes bleeder circuit 130 to increase bleeder current $I_{BL}$ 113 in response to a decrease in the input current $I_{IN}$ 118, and may be configured to output a bleeder control signal 135 that causes bleeder circuit 130 to decrease bleeder current $I_{BL}$ 113 in response to an increase in input current $I_{IN}$ 118. As discussed in greater detail below, bleeder controller 142 may be further configured to detect a disconnect of load 175 based on the input current $I_{IN}$ 118, bleeder current $I_{BL}$ 113, and/or the bleeder control signal $U_{BL}$ 135. In response to detecting the disconnect of load 175, bleeder controller 142 may be configured to disable operation of bleeder circuit 130 by outputting a bleeder control signal $U_{BL}$ 135 that causes bleeder circuit 130 to draw a bleeder current $I_{BL}$ 113 equal (or at least substantially equal) to zero.

Figure 2A:
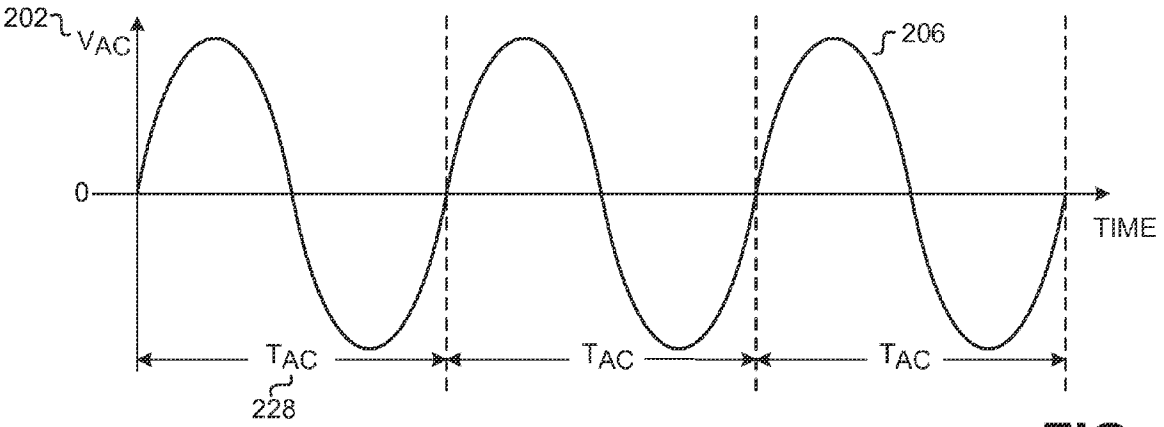
FIG. 2A is an example voltage waveform illustrating an ac input voltage.

The operation of bleeder and load disconnect detection circuit 139 will be described with reference to FIGS. 2-6. FIG. 2A illustrates an example waveform 206 of an input ac voltage $V_{AC}$ 202. In some examples, with reference to FIG. 1A, waveform 206 may represent the input ac line signal $V_{AC}$ 102 received at the input terminals of the LED driver circuit 100. As shown, input ac line voltage $V_{AC}$ 202 is generally a sinusoidal waveform with a period equal to a full line cycle $T_{AC}$ 228. The full line cycle $T_{AC}$ 228 of the input ac voltage $V_{AC}$ 202 is denoted as the length of time between every other zero-crossing of input ac voltage $V_{AC}$ 202.

Figure 2B:
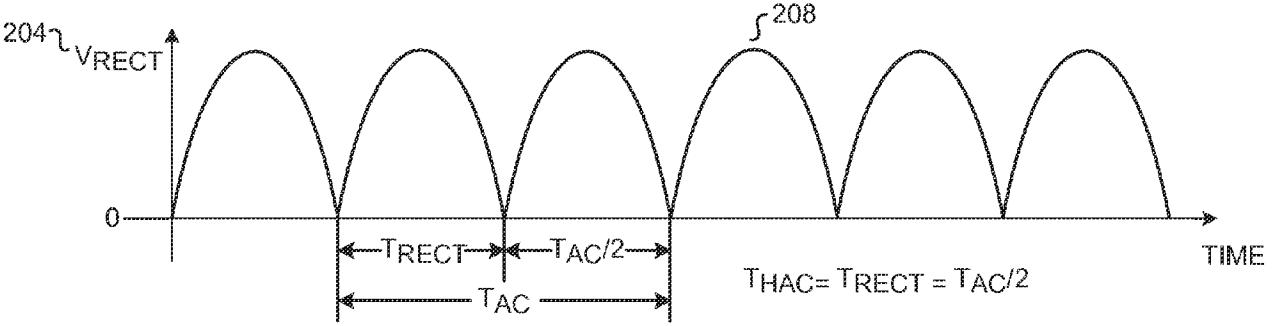
FIG. 2B is an example voltage waveform illustrating a rectified ac input voltage.

FIG. 2B illustrates an example waveform 208 of a rectified ac input voltage $V_{RECT}$ 204. In some examples, with reference to FIG. 1A, the waveform 208 may represent the rectified input voltage $V_{RECT}$ 107 output by rectifier 106 and received by bleeder and load disconnect detection circuit 139. As shown, the rectified ac input voltage $V_{RECT}$ 204 has a half line cycle $T_{AC}/2$ represented as $T_{HAC}$ or $T_{RECT}$. The half line cycle $T_{HAC}$ represents the length of time between consecutive zero-crossings of rectified ac input voltage $V_{RECT}$ 204. As shown, rectified ac input voltage $V_{RECT}$ 204 is zero at the beginning and end of each half line cycle $T_{HAC}$ and peaks at the mid-point of each half line cycle $T_{HAC}$.

Figure 3A:
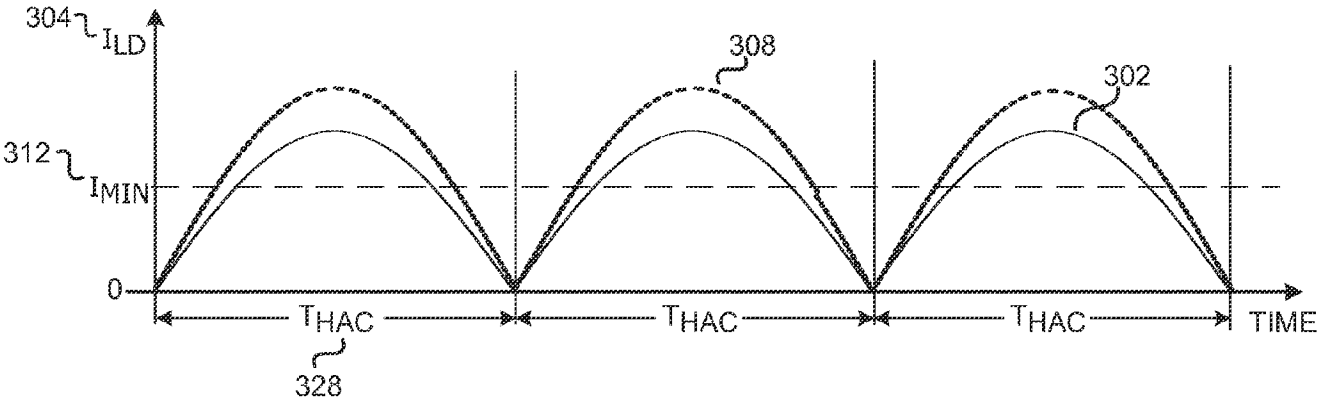
FIG. 3A is an example current waveform illustrating an LED load current of an LED driver circuit during normal operation.

FIG. 3A illustrates an example waveform 302 of a load current $I_{LD}$ 304 of an LED coupled to the output of an LED driver circuit during normal operation. In some examples, with reference to FIG. 1A, waveform 302 may represent the load current $I_{LD}$ 110 drawn by regulated de-de converter 140 during normal operation. Referring back to FIG. 3A, the waveform 302 of the load current $I_{LD}$ 304 may follow the waveform 308 of the rectified input voltage (e.g., rectified ac input voltage $V_{RECT}$ 204), where the load current $I_{LD}$ 304 is at its lowest at the beginning and end of each half line cycle $T_{HAC}$ 328 and peaks at the mid-point of each half line cycle $T_{HAC}$ 328. As shown, the load current $I_{LD}$ 304 falls below the minimum holding current $I_{MIN}$ 312 at the beginning and end of each half line cycle $T_{HAC}$ 328. As described above, the minimum holding current $I_{MIN}$ 312 is the minimum current required to keep a switch of a dimmer circuit (e.g., dimmer circuit 104) that is coupled to the LED driver circuit conducting.

Figure 3B:
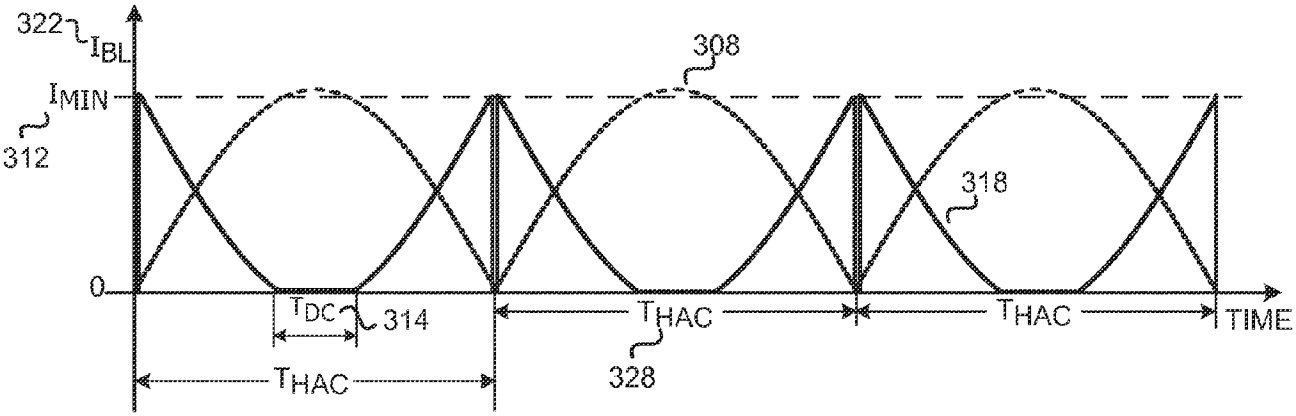
FIG. 3B is an example current waveform illustrating a bleeder current of an LED driver circuit during normal operation.

FIG. 3B illustrates an example waveform 318 of a bleeder current $I_{BL}$ 322 of an LED driver circuit during normal operation. The waveform 318 of the bleeder current $I_{BL}$ 322 may inversely track waveform 308 of the load current $I_{LD}$ 304 such that bleeder current $I_{BL}$ 322 may peak at the beginning and end of each half line cycle $T_{HAC}$ 328 and may be at its lowest (e.g., equal to zero) at the mid-point of each half line cycle $T_{HAC}$ 328. Specifically, at the beginning of each half line cycle $T_{HAC}$ 328, the bleeder current $I_{BL}$ 322 may increase sharply to compensate for the load current being below the minimum holding current $I_{MIN}$ 312. As the load current rises above the minimum holding current $I_{MIN}$ 312, the bleeder current $I_{BL}$ 322 may decrease. In particular, as shown in FIG. 3B, the bleeder current $I_{BL}$ 322 may fall to zero for a time interval or duration $T_{DC}$ 314 corresponding to the peak of the load current $I_{LD}$ 304. In one example, the duration of $T_{DC}$ 314 may have a value of 500 microseconds. However, it should be appreciated that other values of duration $T_{DC}$ 314 may be used depending on the overall system design. As the load current $I_{LD}$ 304 decreases below the minimum holding current $I_{MIN}$ 312 after the mid-point of each half line cycle $T_{HAC}$, the bleeder current $I_{BL}$ 322 may begin to increase towards the minimum holding current $I_{MIN}$ 312. Specifically, the bleeder control signal output by the bleeder controller 142 may transition the switch of the bleeder circuit from an OFF state to an ON state (or a state conducting a non-zero amount of current) after the time period $T_{DC}$ 314 of each half line cycle $T_{HAC}$ 328. Thus, during normal operation, the bleeder control signal output by the bleeder controller may disable the bleeder circuit by causing a switch in the bleeder circuit to be in an OFF state (e.g., a state in which current conduction is prevented) during the interval $T_{DC}$ 314 of each half line cycle $T_{HAC}$ 328 and may enable the bleeder circuit by causing the switch in the bleeder circuit to be in an ON state (or a state conducting a non-zero amount of current) during the remainder of each half line cycle $T_{HAC}$ 328. The bleeder control signal being in or transition ing to an ON signal (e.g., a signal that causes the bleeder circuit to conduct current) during the time period $T_{DC}$ 314 of a half cycle $T_{HAC}$ 328 may be indicative of an open load condition since, during normal operation, the bleeder control signal is expected to be an OFF signal (e.g., a signal that prevents the bleeder circuit from conducting current).

Figure 3C:
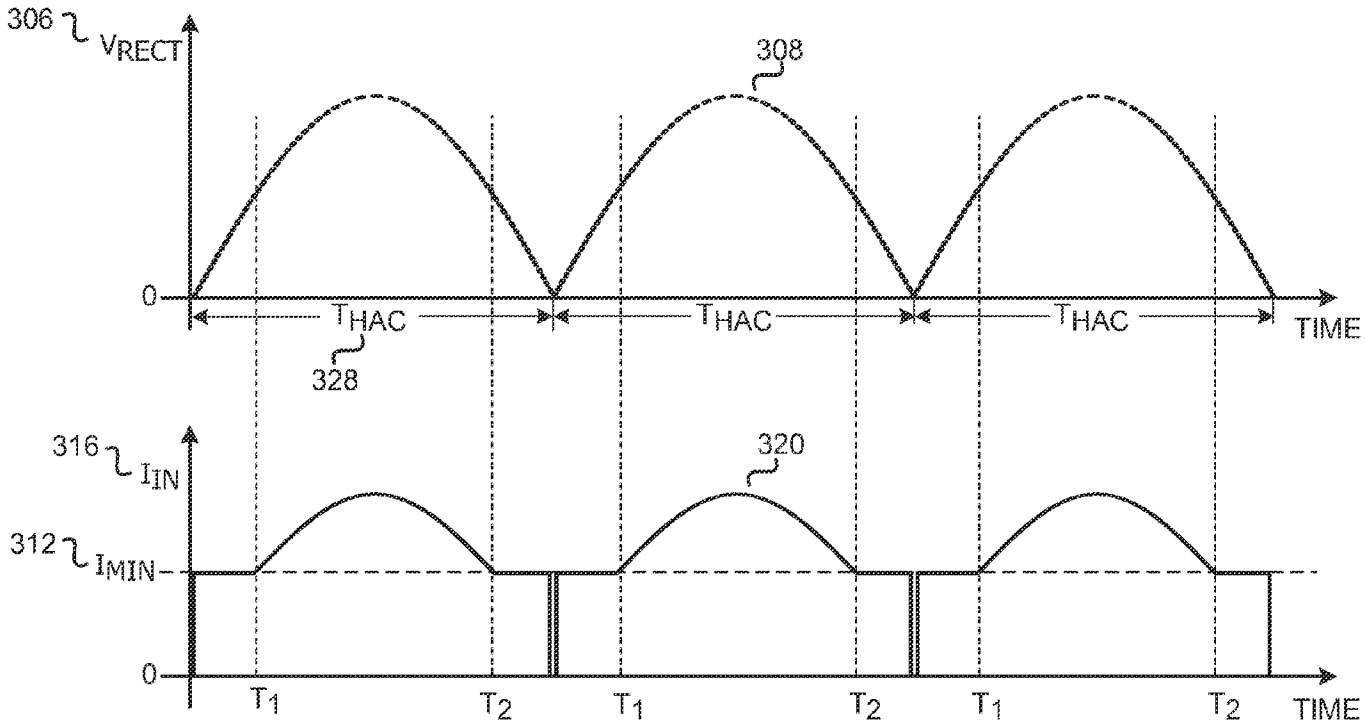
FIG. 3C is an example current waveform illustrating an input current of an LED driver circuit during normal operation.

Since bleeder current $I_{BL}$ 322 may peak while load current $I_{LD}$ 304 is at its lowest and since bleeder current $I_{BL}$ 322 may be at its lowest when load current $I_{LD}$ 304 peaks, bleeder current $I_{BL}$ 322 may complement the load current $I_{LD}$ 304 to maintain an input current $I_{IN}$ 316 above the minimum holding current $I_{MIN}$ 312, as shown in FIG. 3C.

FIG. 3C illustrates an example waveform 320 of the input current $I_{IN}$ 316 of an LED driver circuit 100 during normal operation. In some examples, with reference to FIG. 1A, waveform 320 may represent the input current $I_{IN}$ 118 of the LED driver circuit 100 during normal operation. Waveform 308 may represent the rectified ac input voltage $V_{RECT}$ 306. Referring back to FIG. 3C, input current $I_{IN}$ 316 may include a summation of the load current $I_{LD}$ 304 (shown in FIG. 3A) and the bleeder current $I_{BL}$ 322 (shown in FIG. 3B). Thus, the waveform 320 of the input current $I_{IN}$ 316 may represent the combined waveform 302 and waveform 318. As shown in FIG. 3C, the input current $I_{IN}$ 316 rises sharply at the beginning of each half line cycle $T_{HAC}$ 328 due to the bleeder current $I_{BL}$ 322 rising sharply during these periods. Specifically, at the beginning of each half line cycle $T_{HAC}$ 328, the bleeder current $I_{BL}$ 322 may increase sharply to compensate for the load current being below the minimum holding current $I_{MIN}$ 312. At time interval $T_1$, input current $I_{IN}$ 316 begins to increase to a value above the minimum holding current $I_{MIN}$ 312 due to the load current $I_{LD}$ 304. At time interval $T_2$, $I_{IN}$ 316 decreases to a value above the minimum holding current $I_{MIN}$ 312 due to the load current $I_{LD}$ 304 decreasing while the bleeder current $I_{BL}$ 322 increasing during this time period. Accordingly, the summation of the load current $I_{LD}$ 304 and the bleeder current $I_{BL}$ 322 largely maintains the input current $I_{IN}$ 316 at a value that is greater than the minimum holding current $I_{MIN}$ 312 throughout each half line cycle $T_{HAC}$ 328.

Figure 4A:
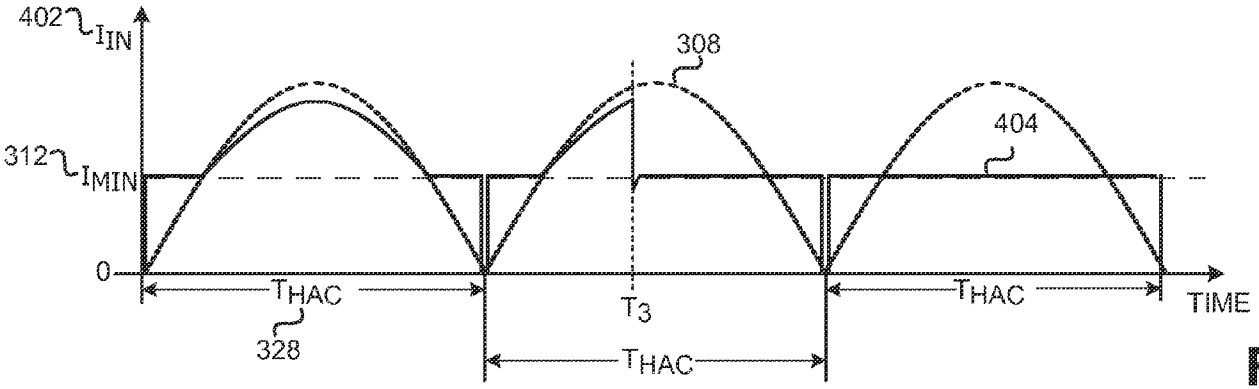
FIG. 4A is an example current waveform illustrating an input current of an LED driver circuit when the LED load is disconnected.

FIG. 4A illustrates an example waveform 404 of an input current $I_{IN}$ 402 of an LED driver circuit when the LED load has been disconnected (e.g., an open load condition). For example, with reference to FIG. 1A, waveform 404 may represent the input current $I_{IN}$ 118 of the LED driver circuit 100 when load 175 has been disconnected. Waveform 308 may represent the rectified ac input voltage $V_{RECT}$ 107. In the first cycle of waveform 404, the LED load is connected and waveform 404 of input current $I_{IN}$ 402 may operate in a manner similar to that of waveform 320, which is shown in FIG. 3C and represents the input current of an LED driver circuit during normal operation. Shortly after the start of the second cycle of waveform 404, the LED load is disconnected, resulting in the load current falling to zero and causing input current $I_{IN}$ 402 to include only the bleeder current. As a result, during the beginning of the second cycle, waveform 404 may operate in a manner similar to that of waveform 318, which is shown in FIG. 3B and represents the bleeder current of an LED driver circuit during normal operation. In response to the input current $I_{IN}$ 402 falling below the minimum holding current $I_{MIN}$ 312 at time $T_3$, bleeder controller 142 may output a bleeder control signal that causes the bleeder current output by the bleeder circuit to increase in order to maintain the input current $I_{IN}$ 402 above the minimum holding current $I_{MIN}$ 312. Specifically, the bleeder control signal output by the bleeder controller 142 may transition the switch of the bleeder circuit from an OFF state to an ON state (or a state conducting a non-zero amount of current) during the time period $T_{DC}$ 314 of each half line cycle $T_{HAC}$ 328 shown in FIG. 3B. As mentioned above, the bleeder control signal being in or transitioning to an ON signal (e.g., a signal that causes the bleeder circuit to conduct current) during the time period $T_{DC}$ 314 of a half line cycle $T_{HAC}$ 328 may be indicative of an open load condition since, during normal operation, the bleeder control signal is expected to be an OFF signal (e.g., a signal that prevents the bleeder circuit from conducting current).

Figure 4B:
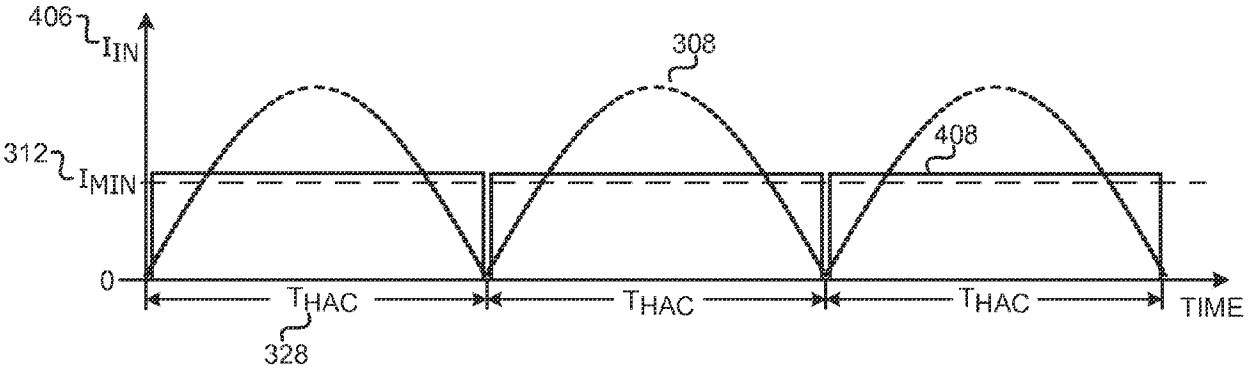
FIG. 4B is an example current waveform illustrating an input current of an LED driver circuit after the LED load is disconnected.

FIG. 4B illustrates an example waveform 408 of an input current $I_{IN}$ 406 of an LED driver circuit after an LED load is disconnected and after the bleeder controller adjusts the bleeder current in response to the open load condition caused by the disconnected load. For example, with reference to FIG. 1A, the waveform 408 may represent the input current $I_{IN}$ 118 of the LED driver circuit 100 after the load 175 is disconnected and after the bleeder controller adjusts the bleeder current in response to the open load condition. As described above, the load current falls to zero when the LED load is disconnected and thus, the input current comprises only the bleeder current. Additionally, to compensate for the absence of a load current, the bleeder controller may cause the bleeder current to increase above the minimum holding current $I_{MIN}$ 312 throughout the majority of each half line cycle $T_{HAC}$ 328, as shown in FIG. 4B. Accordingly, a constant input current $I_{IN}$ 406 having a non-zero value over a threshold length of time during a half line cycle $T_{HAC}$ 328 may be indicative of an open load condition. Additionally or alternatively, a constant bleeder current having a non-zero value over a threshold length of time during a half line cycle $T_{HAC}$ 328 may be indicative of an open load condition.

Figure 5:
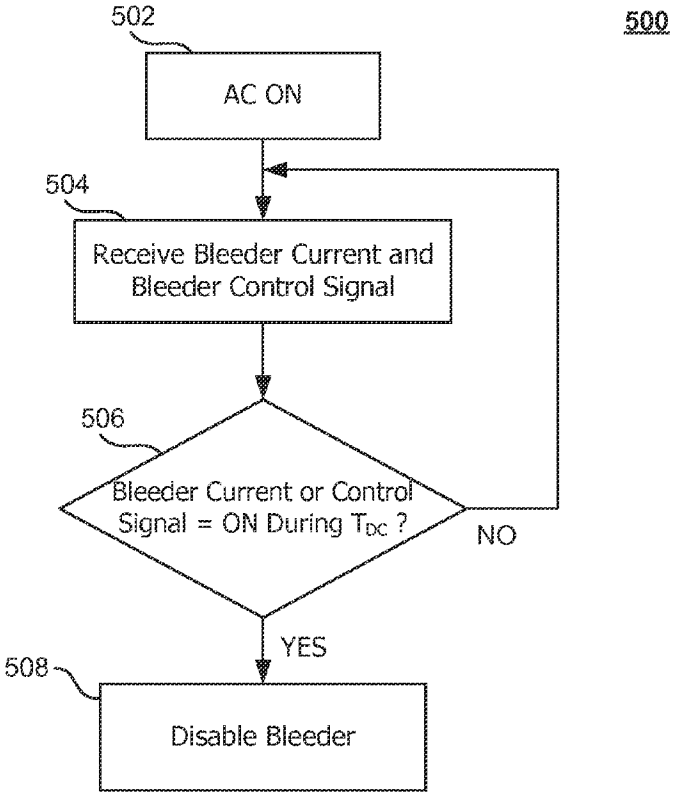
FIG. 5 is a flowchart illustrating an example process for disabling a bleeder circuit in response to detecting the removal of an LED load from the output of an LED driver circuit.

FIG. 5 is a flowchart illustrating an example process 500 for detecting a load disconnect or open load condition of an LED driver circuit shortly after the load is disconnected (e.g., similar to the condition represented by FIG. 4A). In some examples, process 500 may be performed by bleeder controller 142 of LED driver circuit 100. At block 502, the LED driver circuit may power on in response to being supplied with an ac input voltage (e.g., input ac line signal $V_{AC}$ 102). At block 504, a signal representative of a bleeder current (e.g., the current sense signal representative of bleeder current $I_{BL}$ 113 from bleeder current sense circuit 125) of the LED driver and a bleeder control signal (e.g., bleeder control signal 135) may be received by the bleeder controller.

At block 506, it may be determined whether or not a load of the LED driver circuit has been disconnected based on the signal representative of the bleeder current or bleeder control signal received at block 504. In some examples, the bleeder control signal may be used to detect the load disconnect by determining whether or not the bleeder control signal (e.g., bleeder control signal 135) is an ON signal (e.g., a signal that causes the bleeder circuit to conduct current) during a time interval $T_{DC}$ of a half line cycle (e.g., time interval $T_{DC}$ 314 of each half line cycle $T_{HAC}$ 328). As discussed above, during normal operation, the bleeder controller may output a bleeder control signal that causes the bleeder circuit to be in the OFF state during a time period $T_{DC}$ of each half line cycle during normal operation. Thus, in some examples, block 506 may include determining whether the bleeder control signal is an ON signal that causes the bleeder circuit to conduct current during the time interval $T_{DC}$ of a half line cycle. If it is determined that the bleeder control signal is an ON signal during the time interval $T_{DC}$, then it may be determined that the load has been disconnected. If it is instead determined that the bleeder control signal is not an ON signal during the time interval $T_{DC}$, then it may be determined that the load has not been disconnected. In other examples, block 506 may include determining whether the bleeder control signal is an ON signal during the time interval $T_{DC}$ for a threshold number (e.g., one, two, or more) of consecutive half line cycles. If it is determined that the bleeder control signal is an ON signal during the time period $T_{DC}$ for the threshold number of consecutive half line cycles, then it may be determined that the load has been disconnected. If it is instead determined that the bleeder control signal is not an ON signal during the time period $T_{DC}$ for the threshold number of consecutive half line cycles, then it may be determined that the load has not been disconnected.

In other examples, the signal representative of the bleeder current may instead be used to detect a load disconnect by determining whether the bleeder current falls below a threshold value (e.g., falls to zero, a value substantially equal to zero, or another value) during each half line cycle (e.g., time period $T_{DC}$ 314 of each half line cycle $T_{HAC}$ 328). If it is determined that the bleeder current does not fall below the threshold value during each half line cycle, then it may be determined that the load has been disconnected. If it is instead determined that the bleeder current does fall below the threshold value during each half line cycle, then it may be determined that the load has not been disconnected. In other examples, block 506 may include determining whether the bleeder current falls below the threshold value during a threshold number (e.g., one, two, or more) of consecutive half line cycles. If it is determined that the bleeder current does not fall below the threshold value during the threshold number of consecutive half line cycles, then it may be determined that the load has been disconnected. If it is determined that the bleeder current does fall below the threshold value during fewer than the threshold number of consecutive half line cycles, then it may be determined that the load has not been disconnected.

If it is determined, based on the bleeder control signal or the bleeder current, that the load has not been disconnected, process 500 loops back to block 504. However, in response to determining, based on the bleeder control signal or the signal representative of the bleeder current, that the load has been disconnected, the process may proceed to block 508. At block 508, the bleeder controller may disable the bleeder circuit by outputting a bleeder control signal that causes the bleeder circuit to conduct zero (or at least substantially zero) current.

Figure 6:
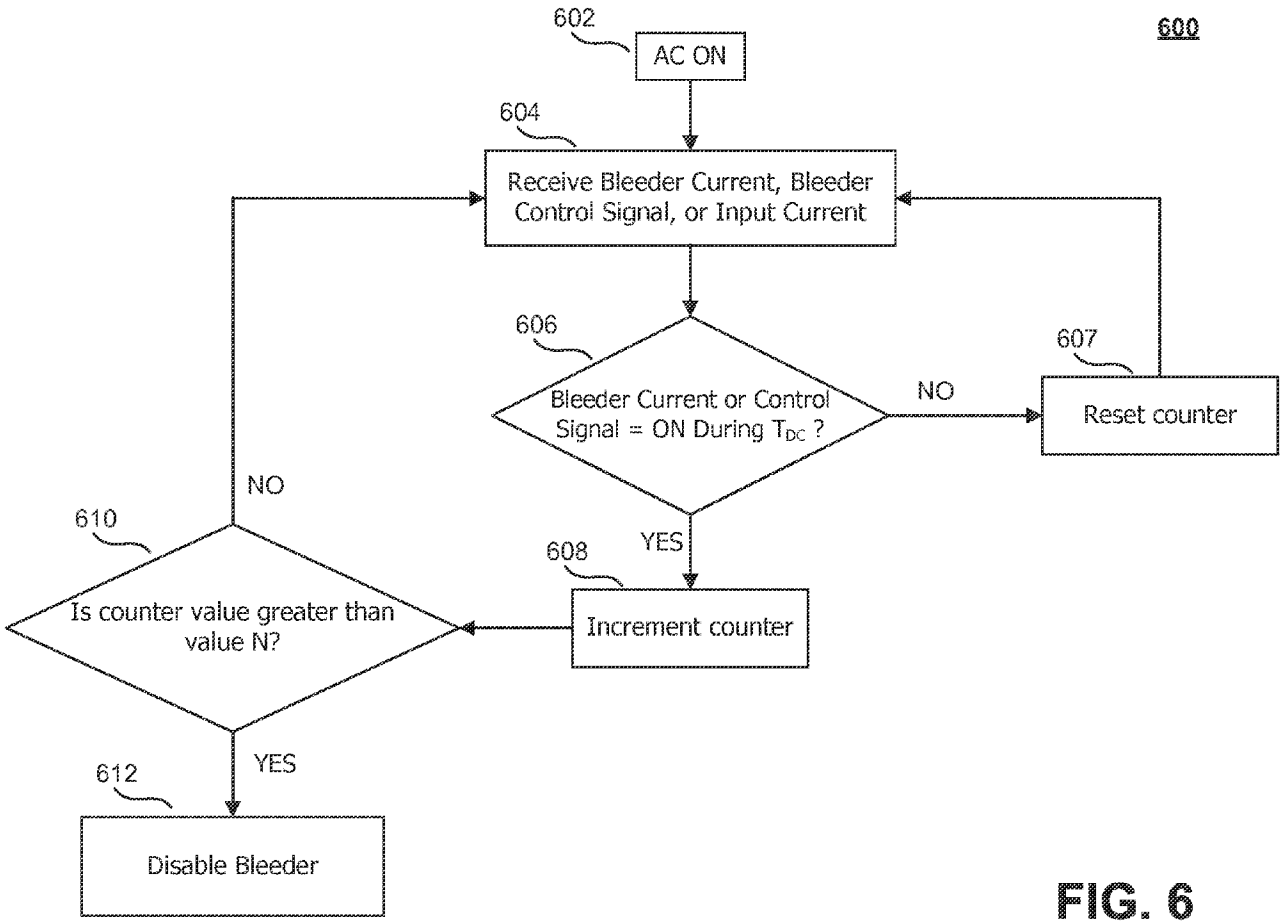
FIG. 6 is a flowchart illustrating another example process for disabling a bleeder circuit in response to detecting the removal of an LED load from the output of an LED driver circuit.

FIG. 6 is a flowchart illustrating an example process 600 for detecting a load disconnect or open load condition of an LED driver circuit after the bleeder controller adjusts the bleeder current in response to the open load condition caused by the disconnected load. (e.g., similar to the condition represented by FIG. 4B). In some examples, process 600 may be performed by bleeder controller 142 of LED driver circuit 100. At block 602, the LED driver circuit may power on in response to being supplied with an ac input voltage (e.g., input ac line signal $V_{AC}$ 102). At block 604, a signal representative of a bleeder current (e.g., the current sense signal representative of bleeder current $I_{BL}$ 113 from bleeder current sense circuit 125) of the LED driver, a bleeder control signal (e.g., bleeder control signal 135), or a signal representative of an input current (e.g., the input current sense signal representative of input current $I_{IN}$ 118 from input current sense circuit 150) of the LED driver circuit may be received by the bleeder controller. The input current may represent a summation of the bleeder current (e.g., bleeder current $I_{BL}$ 113) and the load current (e.g., load current $I_{LD}$ 110) drawn through the LED load.

At block 606, it may be determined whether or not a load of the LED driver circuit has been disconnected based on the bleeder current, bleeder control signal, or the input current received at block 604 during a half line cycle.

In some examples, the bleeder control signal may be used to detect the load disconnect by determining whether the bleeder control signal is constant or within a threshold deviation amount for greater than a threshold length of time for a threshold number of consecutive half line cycles of the ac input voltage or input current $I_{IN}$. For example, it may be determined whether or not the bleeder control signal has an average variation of less than a threshold deviation amount (e.g., 5%, 10%, 20%, etc.) over a sampling duration (e.g., a half line cycle, a portion of the half line cycle, etc.) in a threshold number (e.g., 1, 5, 10, 20, 32, or more) of consecutive half line cycles. If it is determined that the bleeder control signal has an average variation of less than the threshold deviation amount over the sampling duration in the threshold number of consecutive half line cycles, then it may be determined that the load has been disconnected. If it is instead determined that the bleeder control signal does not have an average variation of less than the threshold deviation amount over the sampling duration in the threshold number of consecutive half line cycles, then it may be determined that the load has not been disconnected.

In other examples, the signal representative of the bleeder current or the input current received at block 604 can similarly be used to detect a load disconnect at block 606. For example, the signal representative of the bleeder current or the input current may be used to detect the load disconnect by determining whether the bleeder current or the input current is constant or within a threshold deviation amount tier greater than a threshold length of time for a threshold number of consecutive half line cycles of the ac input voltage or input current $I_{IN}$. If it is determined that the bleeder current or the input current has an average variation of less than the threshold deviation amount over the sampling duration in the threshold number of consecutive half line cycles, then it may be determined that the load has been disconnected. If it is instead determined that the bleeder current or the input current does not have an average variation of less than the threshold deviation amount over the sampling duration in the threshold number of consecutive half line cycles, then it may be determined that the load has not been disconnected.

If it is determined, based on the bleeder control signal, the bleeder current, or the input current, that the load has not been disconnected at block 606, process 600 may proceed to block 607. At block 607, a counter within the control logic block 180 of bleeder controller 142 is reset. The value of this counter represents the number of consecutive half line cycles during which it has been determined that the load has been disconnected.

If it is instead determined at block 606 that the load may have been disconnected based on the bleeder control signal, the bleeder current, or the input current, process 600 may proceed to block 608. At block 608, the counter within the control logic block 180 of bleeder bleeder controller 142 is incremented. Process 600 may then proceed to block 610. At block 610, it is determined whether the value of the counter is greater than or equal to a predetermined value N. The value of N can be selected to be any desired value that represents the number of consecutive half line cycles during which it has been determined that the load has been disconnected, which causes the bleeder controller 142 to disable operation of the bleeder circuitafblee.

If it is determined at block 610 that the value of the counter is greater than or equal to value N, process 600 proceeds to block 612. At block 612, the bleeder controller may disable the bleeder circuit by outputting a bleeder control signal that causes the bleeder circuit to conduct zero (or at least substantially zero) current. The bleeder may be re-enabled if the bleeder and load disconnection circuit 139 is reset. If it is instead determined at block 610 that the value of the counter is not greater than or equal to value N, process 600 may return to block 604.

The above description of illustrated examples of the present invention, including what is described in the Abstract, are not intended to be exhaustive or to be a limitation to the precise forms disclosed. While specific embodiments of and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

These modifications can be made to examples of the invention in light of the above detailed description. The terms used in the following claims should not be construed to limit the invention to the specific embodiments disclosed in the specification and the claims. Rather, the scope is to be determined entirely by the following claims, which are to be construed in accordance with established doctrines of claim interpretation. The present specification and figures are accordingly to be regarded as illustrative rather than restrictive.

What is claimed is:

1. A bleeder and load disconnect detection circuit for a light-emitting diode (LED) driver circuit, the bleeder and load disconnect detection circuit comprising:

a bleeder circuit coupled between first and second input terminals of a dc-dc converter of the LED driver circuit to conduct a bleeder current;

a bleeder current sense circuit coupled between the bleeder circuit and the second input terminal of the dc-dc converter of the LED driver circuit, wherein the bleeder current of the bleeder circuit is conducted through the bleeder current sense circuit, wherein the bleeder current sense circuit is coupled to output a bleeder current sense signal representative of the bleeder current;

an input current sense circuit coupled to the bleeder current sense circuit and coupled to the second input terminal of the dc-dc converter of the LED driver circuit to receive an input current of the dc-dc converter of the LED driver circuit, wherein the input current comprises the bleeder current received from the bleeder current sense circuit, and a load current conducted through a load coupled to the dc-dc converter of the LED driver circuit, wherein the input current sense circuit includes a signal conditioning circuit coupled to receive the input current, wherein the input current sense circuit is coupled to output a low-pass filtered input current sense signal representative of the input current; and a controller coupled to receive the bleeder current sense signal from the bleeder current sense circuit, and the low-pass filtered input current sense signal from the input current sense circuit, wherein the controller is coupled to output a control signal to the bleeder circuit to control the bleeder current, wherein the bleeder circuit is coupled to conduct a variable amount of the bleeder current in response to the control signal to cause a value of the input current to be greater than a minimum current, wherein the variable amount of the bleeder current is determined based on the low-pass filtered input current sense signal, wherein the controller is further coupled to sense the bleeder current sense signal during a predetermined segment of time during each of one or more consecutive half line cycles of the input current, wherein the bleeder circuit is further coupled to prevent conduction of the bleeder current in response to the controller sensing a non-zero amount of the bleeder current during the predetermined segment of time during each of one or more consecutive half line cycles of the input current.

2. The bleeder and load disconnect detection circuit of claim 1, wherein the controller is coupled to determine that the load has been disconnected from the dc-dc converter of the LED driver circuit in response to the controller sensing the non-zero amount of the bleeder current during the predetermined segment of time during each of the one or more consecutive half line cycles of the input current.

3. The bleeder and load disconnect detection circuit of claim 1, wherein the controller is further coupled to determine that the load has been disconnected from the dc-dc converter of the LED driver circuit in response to the controller determining that a value of the control signal is within a threshold deviation amount for each of one or more consecutive half line cycles of the input current.

4. The bleeder and load disconnect detection circuit of claim 1, wherein the bleeder and load disconnect detection circuit is coupled to receive a phase-controlled rectified input voltage from a dimmer circuit and a rectifier.

5. The bleeder and load disconnect detection circuit of claim 4, wherein the dimmer circuit comprises a phase-controlled trailing-edge dimmer circuit.

6. The bleeder and load disconnect detection circuit of claim 1, wherein the minimum current is a holding current of a phase-controlled leading-edge dimmer circuit.

7. The bleeder and load disconnect detection circuit of claim 1, wherein the bleeder circuit comprises a Darlington pair including first and second transistors coupled between the first and second input terminals of the dc-dc converter of the LED driver circuit to conduct the bleeder current.

8. A light-emitting diode (LED) driver circuit comprising:

an input to be coupled to receive an alternating current (ac) input voltage;

a dimmer circuit coupled to the input to receive the ac input voltage and output a phase-controlled ac input voltage;

a rectifier coupled to receive the phase-controlled ac input voltage and output a phase-controlled rectified input voltage;

a power converter coupled to receive the phase-controlled rectified input voltage and output a regulated output signal to a load; and a bleeder and load disconnect detection circuit coupled between the rectifier and the power converter, the bleeder and load disconnect detection circuit comprising:

a bleeder circuit coupled between first and second input terminals of the power converter to conduct a bleeder current;

a bleeder current sense circuit coupled between the bleeder circuit and the second input terminal of the power converter, wherein the bleeder current of the bleeder circuit is conducted through the bleeder current sense circuit, wherein the bleeder current sense circuit is coupled to output a bleeder current sense signal representative of the bleeder current;

an input current sense circuit coupled to the bleeder current sense circuit and coupled to the second input terminal of the power converter to receive an input current of the power converter of the LED driver circuit, wherein the input current comprises the bleeder current received from the bleeder current sense circuit, and a load current conducted through a load coupled to the power converter of the LED driver circuit, wherein the input current sense circuit includes a signal conditioning circuit coupled to receive the input current, wherein the input current sense circuit is coupled to output a low-pass filtered input current sense signal representative of the input current; and a controller coupled to receive the bleeder current sense signal from the bleeder current sense circuit, and the low-pass filtered input current sense signal from the input current sense circuit wherein the controller is coupled to output a control signal to the bleeder circuit to control the bleeder current, wherein the bleeder circuit is coupled to conduct a variable amount of the bleeder current in response to the control signal to cause a value of the input current to be greater than a minimum current, wherein the variable amount of the bleeder current is determined based on the low-pass filtered input current sense signal, wherein the controller is further coupled to sense the bleeder current sense signal during a predetermined segment of time during each of one or more consecutive half line cycles of the input current, wherein the bleeder circuit is further coupled to prevent conduction of the bleeder current in response to the controller sensing a non-zero amount of the bleeder current during the predetermined segment of time during each of one or more consecutive half line cycles of the input current.

9. The LED driver circuit of claim 8, wherein the controller is coupled to determine that the load has been disconnected from the power converter of the LED driver circuit in response to the controller sensing the non-zero amount of the bleeder current during the predetermined segment of time during each of the one or more consecutive half line cycles of the input current.

10. The LED driver circuit of claim 8, wherein the controller is further coupled to determine that the load has been disconnected from the power converter of the LED driver circuit in response to the controller determining that a value of the control signal is within a threshold deviation amount for each of one or more consecutive half line cycles of the input current.

11. The LED driver circuit of claim 8, wherein the dimmer circuit comprises a phase-controlled leading-edge dimmer circuit.

12. The LED driver circuit of claim 8, wherein the dimmer circuit comprises a phase-controlled trailing-edge dimmer circuit.

13. The LED driver circuit of claim 8, wherein the minimum current is the amount necessary to guarantee the correct operation of the dimmer circuit.

14. The LED driver circuit of claim 8, wherein the input current sense circuit further comprises:

a sense resistor coupled to receive the input current, wherein the signal conditioning circuit is coupled to receive a voltage across the sense resistor.

15. The LED driver circuit of claim 8, wherein the bleeder circuit comprises a Darlington pair including first and second transistors coupled between the first and second input terminals of the power converter to conduct the bleeder current.

* * * * *